United States Patent [19]

Perruzza et al.

[11] Patent Number: 5,011,057

[45] Date of Patent: Apr. 30, 1991

[54] BABY CARRIER

[76] Inventors: Cathleen Perruzza, 35 Croteau Cresc., Thornhill, Ont., Canada, L4J 5S7; Anne Briggs, 28 Cranbrooke Avenue, Toronto, Canada, M5M 1M4

[21] Appl. No.: 530,528

[22] Filed: May 30, 1990

[51] Int. Cl.[5] ..... A47D 13/02

[52] U.S. Cl. ..... 224/158; 224/205

[58] Field of Search ..... 224/202, 205, 257, 258, 224/158-161; 2/104

[56] References Cited

U.S. PATENT DOCUMENTS

| | | | |
|---|---|---|---|
| 278,437 | 5/1983 | Lancaster | 224/158 |
| 755,554 | 3/1904 | Turnbull | 224/158 |
| 982,376 | 1/1911 | MacFarlane | 224/158 |
| 2,628,358 | 2/1953 | Neils | 224/158 X |
| 2,689,672 | 9/1954 | Thompson | 224/158 |
| 2,804,249 | 8/1957 | Manalo | 224/158 |
| 2,846,699 | 8/1958 | Watson | 5/98.1 |
| 3,027,058 | 3/1962 | Huber | 224/160 X |
| 3,587,952 | 6/1971 | Higuchi | 224/160 |
| 3,841,543 | 10/1974 | Bolton | 224/158 |
| 4,004,294 | 1/1977 | Pinch | 2/104 |
| 4,166,558 | 9/1979 | Schroeder | 224/158 |
| 4,579,264 | 4/1986 | Napolitano | 224/160 |
| 4,663,782 | 5/1987 | Knox | 2/104 |
| 4,717,056 | 1/1988 | Carmichael | 224/158 |
| 4,730,759 | 3/1988 | Naidu | 224/158 |

FOREIGN PATENT DOCUMENTS

| | | | |
|---|---|---|---|
| 118192 | 3/1944 | Australia . | |
| 0124542 | 6/1947 | Australia | 224/158 |
| 132910 | 9/1947 | Australia . | |
| 0574757 | 1/1946 | United Kingdom | 224/158 |

OTHER PUBLICATIONS

Kidpower Unlimited Inc., Babey Matey, undated, 4 pages.

*Primary Examiner*—Henry J. Recla
*Assistant Examiner*—Casey Jacyna
*Attorney, Agent, or Firm*—Rogers, Bereskin & Parr

[57] ABSTRACT

A baby carrier is provided having a harness, and being adapted to support a baby in the prone position. The baby carrier of the invention comprises an elongate pouch to accommodate the baby, the pouch being located by the harness with respect to a person carrying the baby so that either elongate side of the pouch is adjacent the breast of the person. Openable flaps are provided in each pouch side to access the person's breast so that the baby may nurse. The flaps may be located so that the flap of one side accesses one breast and the flap of the other side accesses the other breast. The sides may be high enough to provide privacy shielding.

7 Claims, 3 Drawing Sheets

FIG. 2
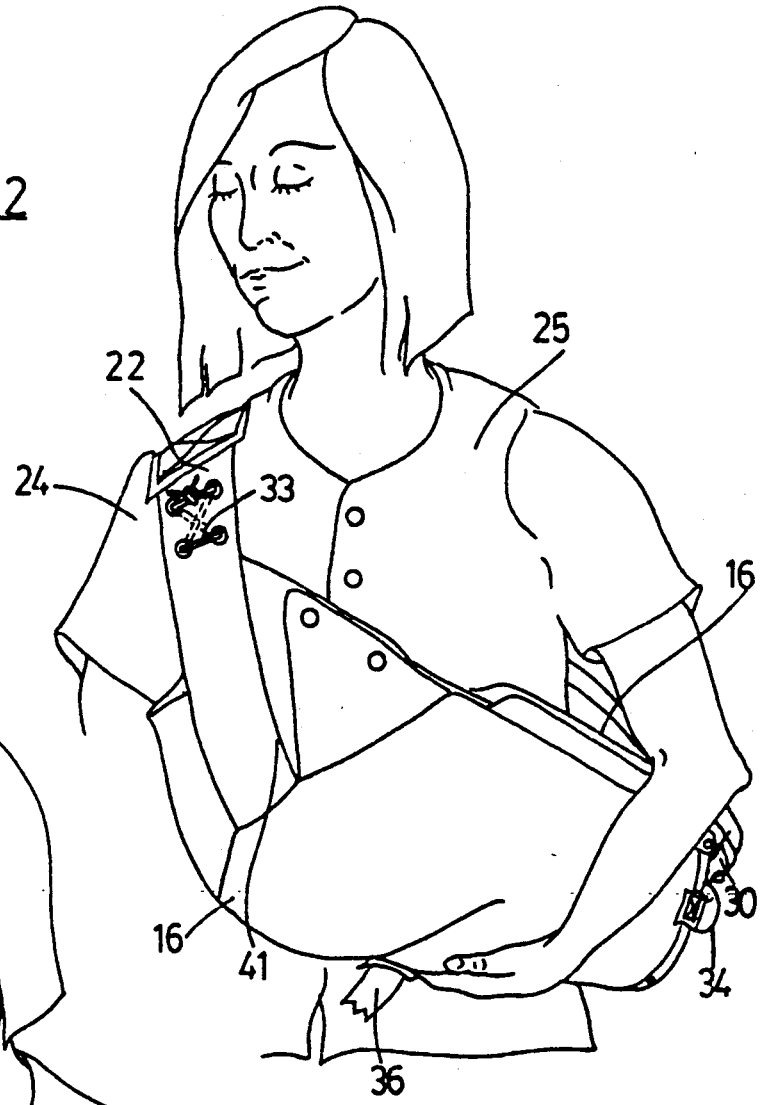
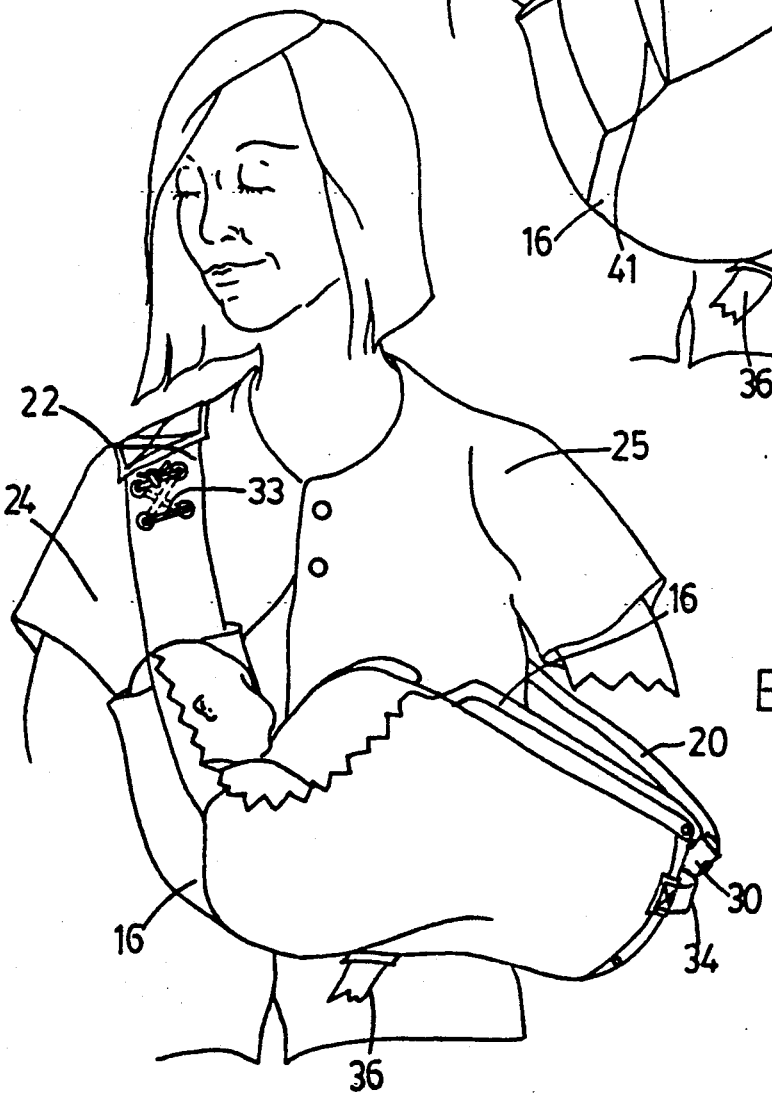
FIG. 3

BABY CARRIER

FIELD OF THE INVENTION

The invention relates to baby carriers of the type having a harness to be worn by a person, usually the mother, to support a baby in the prone position.

BACKGROUND OF THE INVENTION

Many baby carriers or slings are known for use by persons, often a mother, for carrying a baby while leaving the hands at least partially free for other purposes. The baby carriers support the baby's weight other than by the person's arms.

Some such carriers are slings and may be as described and claimed in a variety of U.S. and foreign patents issued over a period from 1883 to at least the mid 1980's. Some commonly availably baby carriers such as the carrier of Napolitano, U.S. Pat. No. 4,579,264, issued Apr. 1, 1986 are designed to carry the baby in a sitting or at lease semi-upright position. Schroeder, U.S. Pat. No. 4,166,558, issued Sept. 4, 1979 discloses a somewhat more complex harness or carrier designed so that the baby may be carried in either the prone position or in a sitting or semi sitting position. Other U.S. patents such as Lancaster, U.S. Pat. No. 278,437, issued May 29, 1883; Turnbull, U.S. Pat. No. 755,554 issued Mar. 22, 1904; McFarlane, U.S. Pat. No. 982,376, issued Jan. 24, 1911; Neils, U.S. Pat. No. 2,628,358, issued Feb. 17, 1953; Thomson, U.S. Pat. No. 2,689,672 issued Sept. 21, 1954; Manalo, U.S. Pat. No. 2,804,249, issued Aug. 27, 1957; and Watson, U.S. Pat. No. 2,846,699 issued Aug. 12, 1958, all disclose various carriers for carrying a baby in the prone position. Of these, only Thomson, U.S. Pat. No. 2,689,672; Watson, U.S. Pat. No. 2,846,699; and Neils, U.S. Pat. No. 2,628,358 disclose pouches having side and end walls. Australian patents Nos. 118,192, published Mar. 9, 1944 and 132,910 published Sept. 18, 1947, both to Farrell, also disclose slings for carrying the baby in a prone position.

A variety of problems have been addressed in these earlier patents, such as the comfort of the person wearing the carrier, the security and position of the baby, the convenience of the harness, the provision of a carrier or sling which will open or disassemble into a blanket or pad on which the baby may be placed on a flat surface, and various other considerations.

However, none of the above prior art addresses the subject of breast feeding the baby while in the baby carrier. It is commonly acknowledged that breast feeding is a natural and advantageous way of feeding a baby, especially a very young baby. However, numerous problems have been encountered by mothers when travelling or carrying their baby on shorter trips in finding sufficient privacy to breast feed the baby without embarrassment. This problem has been sufficiently severe that some women may have chosen to bottle feed their babies in preference to breast feeding.

The clothing industry appears to have been more aware of the problem than the baby carrier industry. There are available on the market, brassieres with either front fastenings for easy access for breast feeding or with openable panels to allow access of the baby to the breast. Moreover, Knox et al, U.S. Pat. No. 4,663,782 issued May 12, 1987 describes and claims a breast feeding garment which may be a blouse having an openable panel located over each breast. The panels may have the appearance of blouse pockets.

It is an aim of the present invention to provide a baby carrier in which the baby may lie during breast feeding and which may provide some privacy for the mother while the baby is so feeding.

SUMMARY OF THE INVENTION

According to the invention there is provided a baby carrier for supporting a baby in the prone position in front of a person carrying the baby, the baby carrier comprising:

an elongate pouch of flexible material to accommodate a prone baby, the pouch having a head end, a foot end and elongate sides adapted to upstand on each side of said baby, each said side having a respective head portion adjacent said head end;

a harness connected to the pouch at said foot end and connected to each said side in the region of said head end, and adapted to pass over one, or alternatively the other shoulder of said person to locate said respective first and second head portions of said sides substantially adjacent respective breasts of said person when the carrier is in use; and, an openable panel in each of said head portions to provide a baby in said carrier access to the respective breast.

Conveniently, an intermediate loop is adapted to pass over one or alternatively the other shoulder of the person and is attached to both the elongate sides of the pouch at the head end. The openable panels may each adjoin a top edge of a respective elongate side and may also each adjoin the intermediate loop. Thus the openable panels may suitably be of triangular configuration. These triangular panels may comprise further generally triangular portions openable along a line extending from the apex of the triangle to a point between the top edge of the respective elongate side and the intermediate loop. There may be considerable overlap between parts of the triangle along this line.

Additional security of the pouch may be provided by a further strap or straps joining the head end of the pouch and the foot part of the pouch behind the person wearing the carrier.

Conveniently the pouch, itself, may be fastened at its foot end and also at its head end by means of fasteners such as snap fasteners or zip fasteners, so that it may be opened, at least partially, into a generally flat pad. This pad may be placed on a flat surface and used as a blanket when the baby is not being carried.

BRIEF DESCRIPTION OF THE DRAWINGS

An embodiment of the invention will now be described by way of example with reference to the drawings in which:

FIG. 2 is a view of the baby carrier of FIG. 1 in use to carry a baby;

FIG. 3 is a similar view to that of FIG. 2 but showing a front elongate side broken away to indicate a baby in the carrier with access to its mother's breast.

DESCRIPTION OF THE PREFERRED EMBODIMENTS

Figure 1:
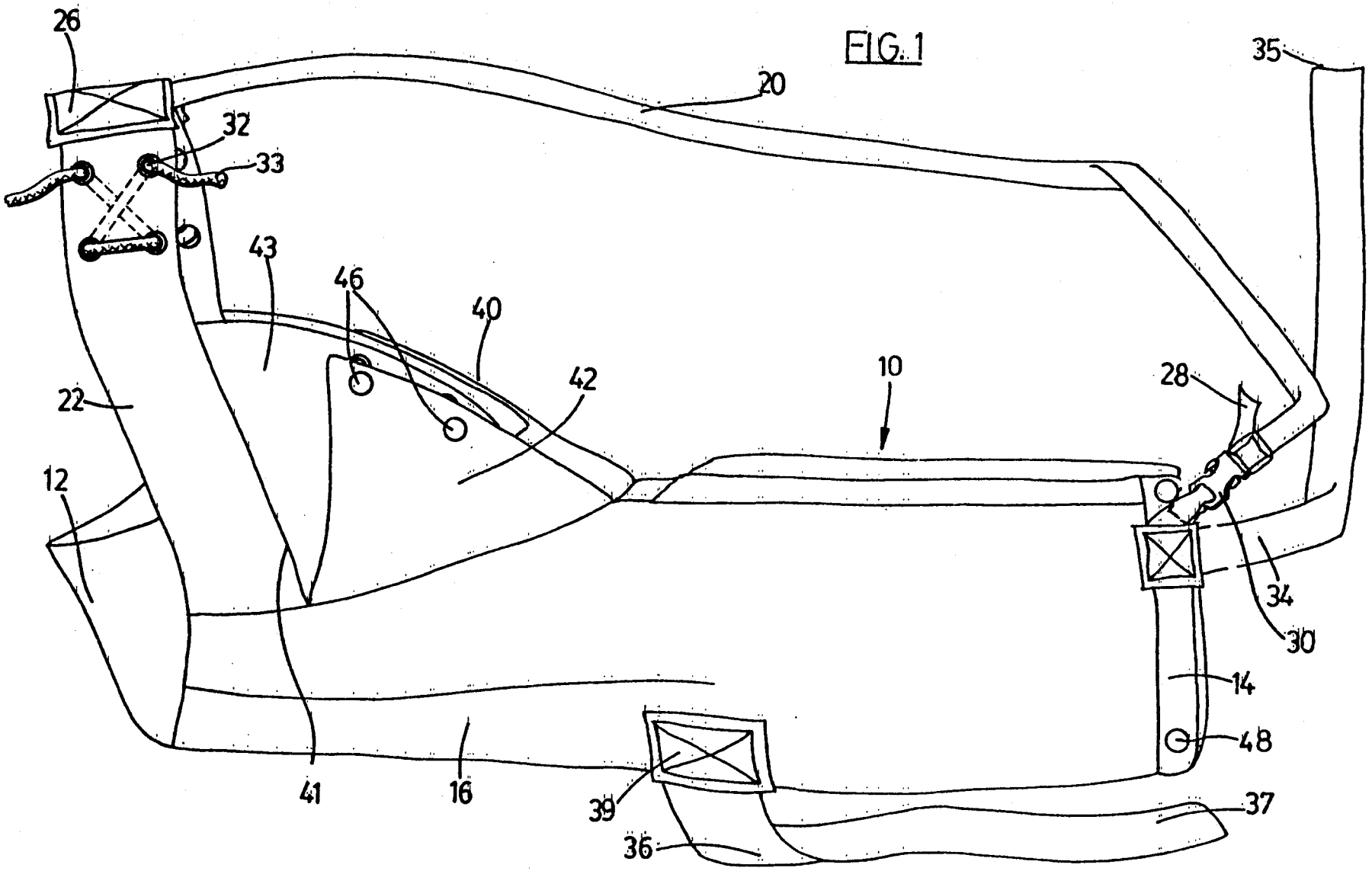
FIG. 1 is a diagrammatic view of a baby carrier according to the invention as seen from the side.

A baby carrier according to the invention comprises a pouch generally indicated by reference 10 having a head end 12 and a foot end 14 between which extend elongated side walls 16. The pouch 10 may be made from flexible sheet material such as plastic material sheet or fabric materials or it may have an outer layer of plastic material sheet and be lined with a fabric material.

The baby carrier illustrated also includes a harness so that it may be carried by a person while leaving the person's arms at least partially free for other purposes.

The harness includes a shoulder strap 20 which is adapted to pass over one shoulder 24, or alternatively the other shoulder 25, of the person wearing the harness. The shoulder strap 20 is attached to both the elongate sides 16, through an intermediary loop 22, ends of which rise from and are continuous with respective elongate sides 16, as illustrated. The intermediary loop 22 connects each elongate side 16 to strap 20 so that a load in the pouch bearing on strap 20 will automatically hold the elongate side walls 16 upstanding about the baby. Other suitable means of connecting strap 20 to the side walls 16 may be used. For example, strap 20 may be divided.

Figure 4:
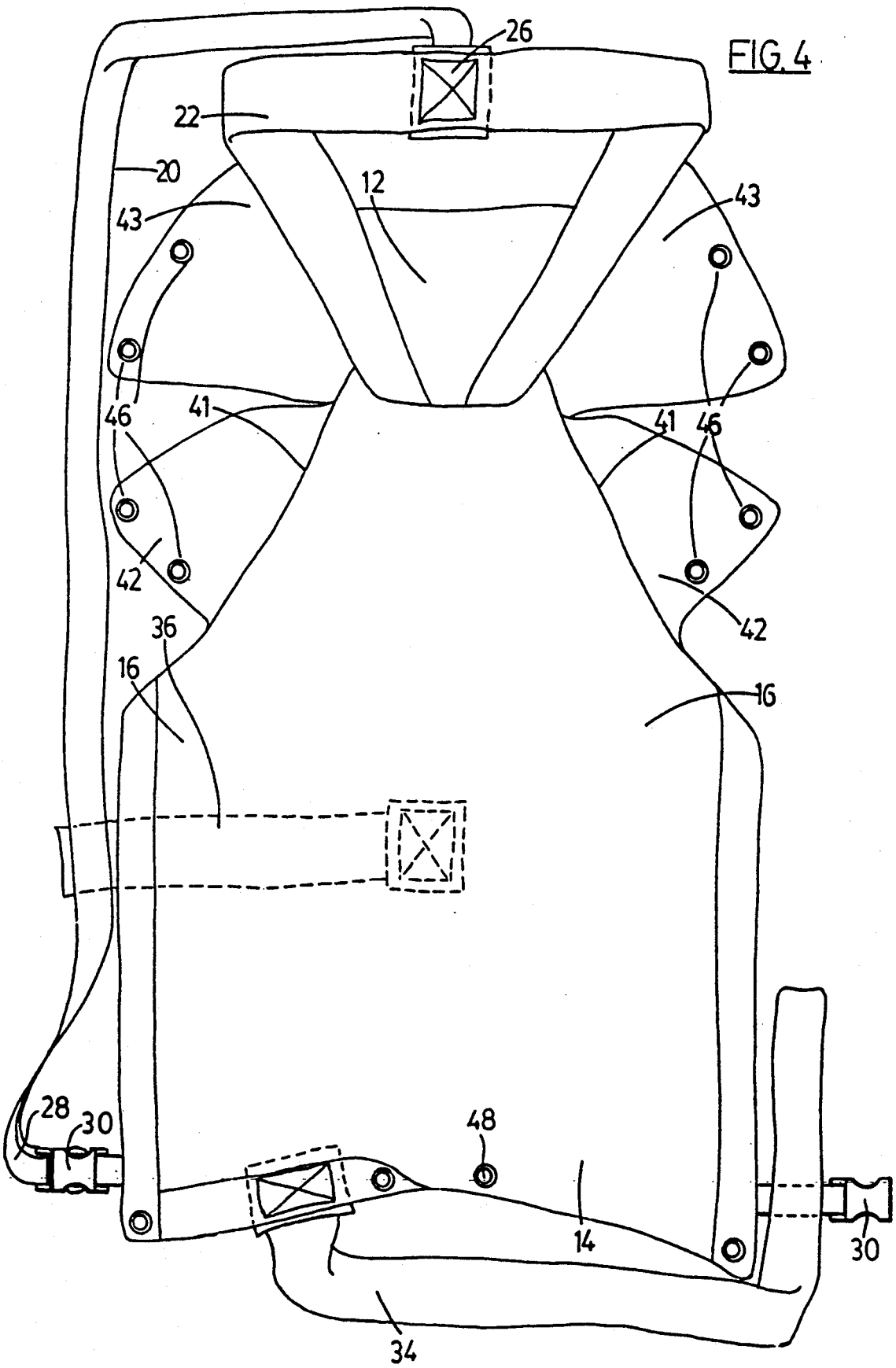
FIG. 4 is a plan view of the baby carrier of FIGS. 1, 2 and 3 in opened condition as a blanket.

The loop 22 forms a bridge above the pouch between sides 16. The strap 20 at one end 26 is connected to the loop 22 at about its mid point and leads upwardly over the shoulder 24 of the mother. The other end 28 of strap 20 may be free and adapted to fasten with a corresponding fastener 30 located substantially at the foot end 14 of the pouch. The fastener 30 may be a buckle, or alternatively, locking loops or any other convenient fastener. A fastener 30 may be provided on both sides of the pouch 10 as shown in FIG. 4.

Adjustment of the length of the strap 20 suitable to locate the pouch at or just below breast level of the mother may be at the fastener 30. Alternatively, or additionally, loop 22 may be provided with means to lengthen or shorten it, such as openings 32 which may be eyelets or button holes, spaced apart along the length of loop 22 and laces 33 threaded therethrough. Tightening of the laces 33 will cinch up the portion of the loop 22 therebetween to shorten the effective length of the strap 22. Alternatively, corresponding snap fasteners may be used instead of the openings 32 which, when fastened together, form a tuck in loop 22, thereby shortening the effective length of shoulder strap 20.

Further waist harness straps 34, and 36 may be provided to connect suitable points of the pouch behind the wearer. As illustrated, strap 34 having a free end 35 is connected to the foot end 14 of the pouch 10 and strap 36 having free end 37 is connected to a point 39 at the bottom and about mid way along the pouch 10. Ends 35, 37 may be tied behind the wearer, to adjust the position of the pouch more accurately with respect to the wearer's breast, as will be further explained hereafter.

The harness straps 20, 22, 34 and 36 may be formed for example of fabric, the same or different to that of the pouch or they may be formed of webbing. Conveniently the pouch and harness may both be made from a reasonably soft but durable fabric to be comfortable for both mother and baby. Corduroy may be suitable and is convenient for stitching in manufacture. Flannelette may be a suitable lining.

In the angle between each respective side wall 16 and the loop 22, are located privacy nursing panels 40 made up of generally triangular portions 42 and 43. Each of these triangular portions 42 and 43 as shown, extend downwardly into a cut-away 41 of the respective side wall 16. More importantly, each panel 40 rises from its respective side wall 16 to upstand about it, to act as at least a partial shield for the body portion of the mother behind it.

In use, when the baby is in the carrier, the harness is adjusted by fastener 30 and snap fasteners 32 to locate the panel 40 which is adjacent the mother to be immediately adjacent one breast, so that the nipple is reasonably centrally located in the panel 40. Some further adjustment of the location of the pouch to achieve the accurate placing of the panel 40 may be achieved through straps 34, 36 which may conveniently be tied behind the mother's back to further secure the carrier and to achieve a degree of lateral adjustment. For example, if the appropriate panel 40 lies to the right of the mother's right breast with straps 34, 36 united, the mother may adjust the lateral position by pulling strap 34 to the left and behind her to be with strap 36 when the appropriate position is reached. If the panel 40 lies to the left of the mother's right breast with straps 34, 36 untied, the mother may pull strap 36 to the right and behind her to tie with strap 34. A single strap may be provided in place of straps 34, 36 to engage with a fastener on the pouch. In that case the mother must physically move the pouch itself to the right position before fastening the strap.

Each nursing panel 40 is adapted to open to allow a baby in the carrier access to its mother's breast, clothing permitting. The triangular portions 42, 44 may overlap and be fastenable together by any suitable means, for example, snap fasteners 46 or a zipper.

When breast feeding is necessary or desirable, the mother may unfasten the panel 40 nearest to her in side 16, (see FIG. 3) fold back portions 42, and 43 and adjust her clothing to expose her breast. As shown in FIG. 2, the other nursing panel 40 which remains fastened acts as a privacy shield behind which the baby may feed without embarrassment to the mother. When the time comes to change breasts, the mother refastens the panel 40 nearest to her, adjusts her clothing, removes the harness from its location on shoulder 24 unfastens the fastener 30, connects the end 28 of the strap 20 to the opposite fastener 30, and relocates the harness on shoulder 25. This involves turning the pouch 10 so that the other side 16 is now nearer the mother and nursing panel 40 in that side 16 is now located adjacent the mother's other breast. She may now open the panel 40 in the side 16 adjacent to her and the opposite panel 40 in the side 16 away from her acts as a privacy shield.

The side walls 16 may be releasably fastened together at the foot end 14 by fasteners 48 as shown in FIGS. 1 and 4. When fasteners 48 at the foot end 14, fasteners 46 in both nursing panels 40 and fastener 30 are all released the carrier may take the flattened form shown in FIG. 4. In this form it is useful as a blanket or pad on which the baby lies for diaper or clothes changing.

It is to be understood that what has been described is a preferred embodiment of the invention and that variations may be apparent to those skilled in the relevant arts without departing from the spirit and scope of the invention as set out in the claims below.

We claim:

1. A baby carrier for supporting a baby in prone position at least in front of a person carrying the baby, said baby carrier comprising:

an elongate pouch of flexible material to accommodate a prone baby, said pouch having a head end, a foot end and elongate sides adapted to upstand to each side of said baby, each said elongate side having a respective head portion toward said head end;

a harness connected to said pouch at said foot end, and connected to each said elongate side in the region of said head end, and adapted to pass over one, or alternatively the other, shoulder of said person, to locate said respective head portions of said elongate sides adjacent respective breasts of said person when said carrier is in use; and an openable panel in each of said head portions to provide a baby in the said carrier access to the respective breast wherein each panel can be opened independently of the other panel.

2. A baby carrier as claimed in claim 1 in which said harness attaches to an intermediate loop which is adapted to pass over said one or alternatively said other shoulder of said person and attaches to both said elongate sides of the pouch at said head end.

3. A carrier as claimed in claim 2, in which said openable panels each adjoin a respective top edge of said elongate sides and each adjoin said intermediate loop.

4. A carrier as claimed in claim 3, in which said openable panels are substantially triangular having one edge adjoining a respective elongate side, one edge adjoining said intermediate loop and one free edge.

5. A carrier as claimed in claim 4, in which said openable panels further comprise a pair of generally triangular portions and are openable along a line extending from the apex of the triangle at the juncture of said intermediate loop and said respective elongate side to a point on said free edge.

6. A carrier as claimed in claim 1 further having at least one strap adapted to connect parts of said pouch behind said person.

7. A carrier as claimed in claim 1, in which, at least said pouch is convertable to a spreadable sheet through the provision of fasteners releasably connecting said elongate sides.

* * * * *